US005902431A

United States Patent [19]

Wilkinson et al.

[11] Patent Number: 5,902,431

[45] Date of Patent: May 11, 1999

[54] COMPOSITE WEB FORMING APPARATUS AND METHOD

[75] Inventors: Donald Ross Wilkinson, Clemmons; John Larkin Nelson, Lewisville; Jeffrey Kane Rogers, Winston-Salem; Vernon Brent Barnes, Advance; Barry Smith Fagg, Winston-Salem, all of N.C.

[73] Assignee: R. J. Reynolds Tobacco Company, Winston-Salem, N.C.

[21] Appl. No.: 08/869,110

[22] Filed: Jun. 4, 1997

[51] Int. Cl.[6] ..... B31F 5/06; B32B 31/00

[52] U.S. Cl. ..... 156/159; 156/260; 156/304.3; 156/502

[58] Field of Search ..... 156/157, 159, 156/259, 260, 271, 304.1, 304.3, 502, 504, 516, 517; 242/551, 552, 554, 554.4, 556.1; 493/381; 270/52.1

[56] References Cited

U.S. PATENT DOCUMENTS

| | | | |
|---|---|---|---|
| 3,645,463 | 2/1972 | Helm | 242/552 |
| 3,793,061 | 2/1974 | Hammel et al. | 117/106 R |
| 3,910,166 | 10/1975 | Sexstone | 93/1 C |
| 4,077,580 | 3/1978 | Lang et al. | 242/554.2 |
| 4,245,795 | 1/1981 | Ludszeweit et al. | 242/556.1 X |
| 4,473,430 | 9/1984 | Voltmer et al. | 156/504 |
| 4,549,875 | 10/1985 | Pryor | 493/49 |
| 4,738,739 | 4/1988 | Schoonderbeek | 156/159 |
| 5,065,776 | 11/1991 | Lawson et al. . | |
| 5,568,819 | 10/1996 | Gentry et al. | 131/342 |
| 5,590,449 | 1/1997 | Chehab et al. | 28/240 |
| 5,733,234 | 3/1998 | Greiner et al. | 493/4 |

FOREIGN PATENT DOCUMENTS 0 562 474 A2 9/1993 European Pat. Off. .

*Primary Examiner*—Michael W. Ball
*Assistant Examiner*—Shawn A. Mitchell

[57] ABSTRACT

A method of and an apparatus for forming a composite web for use in making a fuel element for smoking articles comprises a dual bobbin unwinder from which alternate glass fiber webs are unwound. A splicing apparatus is used to splice together the webs unwound from the two bobbins of the unwinder. Sensing and speed controls are provided for sensing unwinding speed and the amount of web remaining on a bobbin for controlling web accumulation prior to splicing and stopping of the web to effect a splice. Downstream of the splicing apparatus the web is fed to a composite web former where it is slit into equal halves and vertically separated. A paper web is guided between the two web halves and the webs are converged into a three layer composite web with the paper web sandwiched between the glass fiber web halves. The composite web is fed to a KDF filter maker where it is combined with a carbonaceous rod for making a fuel element.

9 Claims, 6 Drawing Sheets

COMPOSITE WEB FORMING APPARATUS AND METHOD

FIELD OF THE INVENTION

The present invention relates to a composite web handling apparatus and method, and more particularly to a system and method for handling a glass fiber web used in the manufacture of smoking articles similar to conventional cigarettes.

BACKGROUND OF THE INVENTION

Smoking articles are known which have a fuel element is attached to one end thereof to provide heat generation for operation of the smoking article. The fuel element comprises a carbonaceous fuel rod wrapped in a glass fiber web and overwrapped with a paper wrapper or plug wrap. Such smoking articles are disclosed, for example, in U.S. Pat. Nos. 4,714,082; 4,756,318; and 5,065,776 assigned to the assignee of the present invention, the disclosures of which are incorporated herein by reference.

In one method of making the fuel element of such smoking articles, a web of reconstituted tobacco paper is disposed between two identical webs of a glass fiber material to form a composite web which is then wrapped about a continuously extruded carbonaceous fuel rod and overwrapped with a paper wrapper which may also be tobacco paper, as described in European Patent Application No. 562,474, published Sep. 29, 1993. In order to economically produce such smoking articles, it is necessary to form the various components of the smoking article in a continuous process at high production rates.

Conventional cigarette making machinery typically operates at the high production rates contemplated by the present invention. One conventional apparatus for making cigarette filters, known as a KDF filter maker, may be employed in the manufacture of fuel elements for the smoking articles described in the aforesaid patents. However, the apparatus upstream of the KDF filter for supplying the components of the fuel element is substantially different from that used to make conventional cigarette filters. The present invention is directed to that apparatus and, in particular, to the various components of the apparatus for forming the aforesaid composite web from rolls of glass fiber material and tobacco paper and supplying the composite web to the KDF filter maker for making the fuel element of the smoking article.

SUMMARY AND OBJECTIVES OF THE INVENTION

The present invention is directed to a system and method for handling the different web materials used to form a continuous composite web for manufacturing the fuel elements for the above-described smoking articles. In particular, the fuel element constructed with the apparatus and method of the invention may be that disclosed in the aforementioned U.S. Pat. No. 5,065,776 to Lawson et al.

The components of the fuel element comprise an extruded carbonaceous rod, a glass fiber web which may be composed of Owens-Corning C-glass mat having an uncompressed thickness of about 1.0 mm and a width of about 38 mm, a web of reconstituted tobacco paper having a thickness of about 0.13 mm and a width of about 19 mm and a web of paper similar to a plug wrap having a thickness of about 0.13 mm and a width of about 26.5 mm. The carbonaceous rod may have a composition described in the aforesaid U.S. Pat. No. 5,065,776 and is continuously extruded from a screw-type extruder and delivered via an elongated V-shaped trough to a KDF filter maker where it is wrapped with a composite web formed from the above-described glass and tobacco paper webs, then overwrapped with the paper wrap.

The apparatus of the invention comprises a web unwinder that supports two bobbins of wound C-glass mat material slit into web widths of about 38 mm with approximately ten individual webs per bobbin. The glass webs are drawn alternately from the two bobbins and are automatically spliced together to provide a continuous supply of glass web. The web unwinder indexes the bobbins transversely so that the webs being unwound are aligned with the web feed path through the apparatus. Upon depletion of the last web on one bobbin that bobbin is replaced with a full bobbin during unwinding of the web on the other bobbin so that operation of the overall proceeds continuously without stoppage even during bobbin replacement.

The webs of both bobbins are threaded about rollers and a control dancer for feeding to a splicer apparatus located downstream of the unwinder. Just prior to the splicing operation, the depletion state of the web being unwound from a first bobbin is sensed and the web unwind speed is increased to fill a web reservoir downstream of the splicer with sufficient web material to permit web unwinding to stop so that the splicing operation can proceed. When the trailing end of a web being unwound from the first bobbin passes into the splicer, unwinding is temporarily stopped and the trailing end of the just-unwound web is automatically spliced to the leading end of the next web to be unwound from the second bobbin.

The splicer apparatus includes clamps for holding the webs and cutters for squaring the ends of the webs to be spliced. Upper and lower tape applicators in the splicer apparatus are loaded by an operator with short sections of splicing tape and when the ends of the leading and trailing webs are in position slightly spaced apart and clamped, the tape is automatically applied to the upper and lower surfaces of the webs to effect the splice and the tape applicators and clamps are retracted. A capstan roller downstream of the splicer then pulls the spliced web through the splicer and the web is payed out from the second bobbin. The operator then loads the leading end of the next web from the first bobbin and the splicing tape sections into the splicer apparatus in preparation for the next splice.

During the splicing operation, the accumulated glass web in the web reservoir is taken up so that the KDF filter maker continuously runs at a high production speed even when the web is temporarily stopped for splicing. From the web reservoir, the glass web is fed to a slitter where it is slit longitudinally into two equal widths of about 19 mm each. The two webs are then guided by a roller system into vertically spaced paths. A web of tobacco paper also having a width of about 19 mm is payed off a bobbin and guided by the roller system to a position intermediate the two glass webs. The axes of the three webs are initially transversely offset from one another, but are guided by the roller system into alignment one over another and then into contact with one another with the tobacco web sandwiched between the two glass webs to form a composite, three-layer web. The composite web is then guided into the KDF filter maker where it is wrapped about the extruded carbonaceous fuel rod, overwrapped with the paper wrap and glued along a longitudinal seam in a manner similar to wrapping and gluing a plug wrap about a conventional cigarette filter.

According to the method aspects of the invention, the method of making the carbonaceous fuel element is a continuous process including the steps of continuously extruding a carbonaceous rod component, continuously feeding the rod component to a KDF filter maker, continuously supplying a glass web and a tobacco paper web, slitting the glass web into two equal width webs, guiding the tobacco paper web between the two glass webs, sandwiching the three webs together to form a composite web, wrapping the composite web about the carbonaceous rod component to combine the same, overwrapping the combination with a paper web and sealing the overwrapped paper web longitudinally to form the carbonaceous fuel element. A further aspect of the method of the invention includes the automatic splicing of the glass webs drawn from a pair of bobbins in a dual bobbin unwinder so that the production speed of the KDF filter maker can be maintained without interrupting the process to splice the glass webs.

From the foregoing it will be apparent that a primary objective of the invention is to provide a method of and an apparatus for making a carbonaceous fuel element for a smoking article in a continuous process at high production speeds comparable with the present high production speeds of making conventional cigarette filters and cigarettes.

It is another object of the present invention to provide a production process and apparatus for making a carbonaceous fuel element for a smoking article which are reliable and not subject to problems of frequent breakage of the fuel element components which has characterized some of the prior art processes and apparatus.

A further object of the invention is to provide a substantially automatic process and apparatus for securely splicing the ends of two glass webs in such a way as to insure reliability of the splice.

Another object of the invention is to provide a splice structure and method for splicing two glass webs together with tape in such a way to permit the splice to be passed about relatively small diameter rollers and otherwise tensioned and stressed without separating or weakening the splice.

With the foregoing and other objects, advantages and features of the invention that will become hereinafter apparent, the nature of the invention may be more clearly understood by reference to the following detailed description of the invention, the appended claims and to the several views illustrated in the drawings.

DETAILED DESCRIPTION OF THE INVENTION

Figure 1:
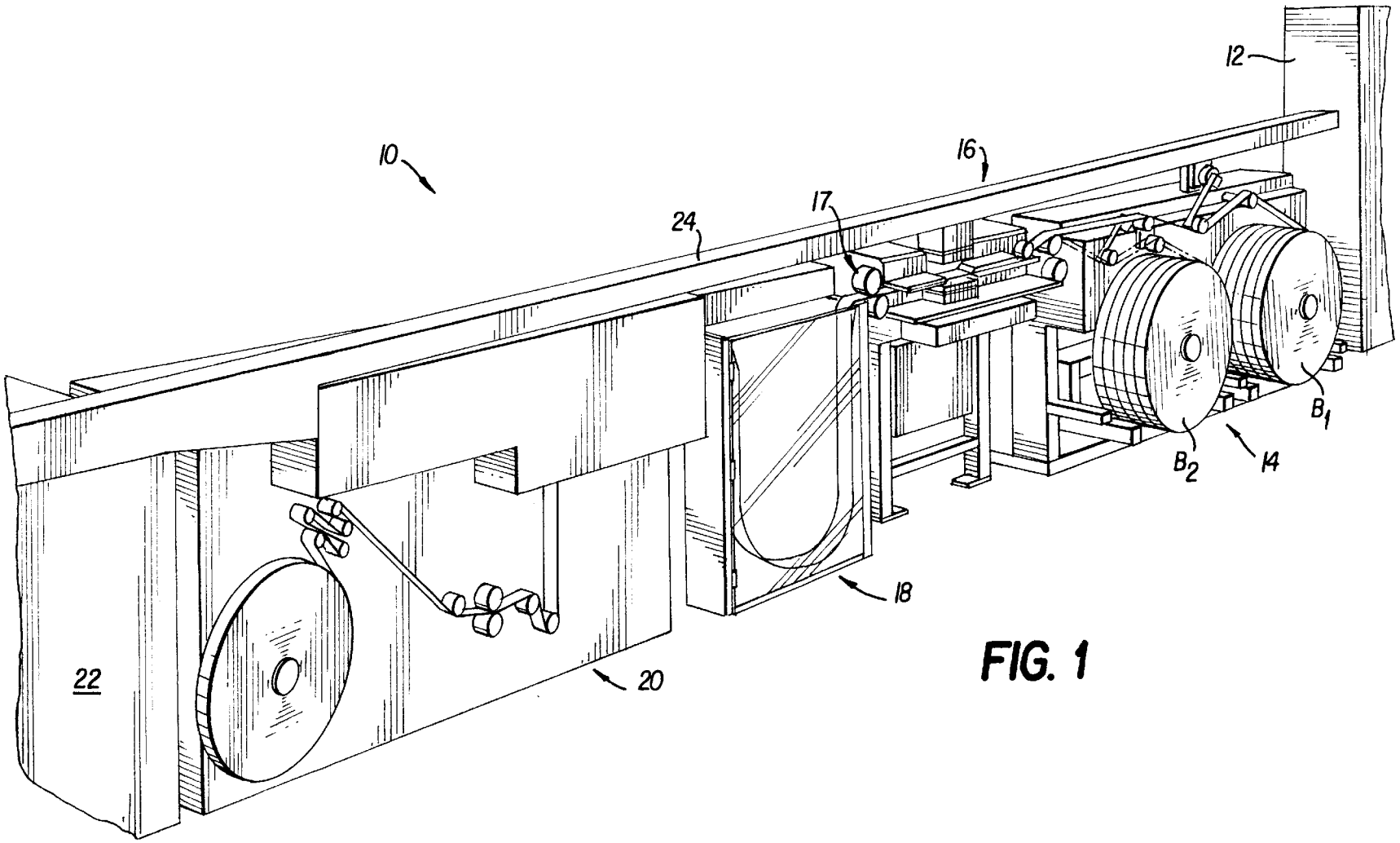
FIG. 1 is a perspective view of the apparatus of the invention for making a carbonaceous fuel element.

Referring now in detail to the drawings, FIG. 1 illustrates an overall perspective view of the apparatus of the invention for making a carbonaceous fuel element for a smoking article which apparatus is designated generally by reference numeral 10. Apparatus 10 comprises six major components: an extruder 12 for extruding a carbonaceous fuel rod, a dual bobbin unwinder 14 for unwinding slit webs of glass fiber mat material, a splicer apparatus 16 for semi-automatically splicing alternate webs of glass mat unwound from the dual bobbin unwinder, a web reservoir 18 for accumulating web during the splicing operation, a composite web maker 20 and a KDF filter maker 22 modified to form a carbonaceous fuel element. The extruder 12 produces an extruded carbonaceous rod which is conveyed in a V-shaped groove (not shown) of a conveyor 24 that is disposed above the other components of the apparatus to the KDF filter maker 22 where it is used to form the carbonaceous fuel element.

The dual bobbin unwinder 14 (FIG. 2) comprises a frame 26 for supporting first and second bobbin chucks 28, 30, respectively. On each chuck there is supported a respective bobbin $B_1$, $B_2$ wound with a glass fiber web, such as an Owen-Corning C-glass mat, which has been slit into ten or more web strips $W_1$ and $W_2$ each having a width of about 38 mm. Each bobbin chuck 28, 30 is rotated by means of a respective servo drive motor (not shown) which is mounted on respective first and second carriages 32, 34 movable back and forth independently of one another and transversely with respect to the payout direction of the webs $W_1$, $W_2$.

The webs $W_1$, $W_2$ are both aligned with a given path of travel of the web through the apparatus 10. When one of the webs $W_1$ or $W_2$ is payed out from a given bobbin $B_1$ or $B_2$, the carriage 32, 34 supporting that bobbin is indexed transversely by conventional means (not shown) one web width (38 mm) so as to bring a next adjacent web $W_1$ or $W_2$ into alignment with the given web path. The bobbin chucks 28, 30 are positively driven or rotated by the servo drive motors at a speed controlled by a capstan roller 17 (FIG. 1) located on the web path between the splicer apparatus 16 and the web reservoir 18. The capstan roller 17 is, in turn, synchronized to the speed of the KDF filter maker 22. As the web $W_1$ or $W_2$ is payed out, the bobbin chuck 28 or 30 must be rotated at an increasing speed to maintain a constant web pay out speed equal to the capstan roller speed.

Figure 2:
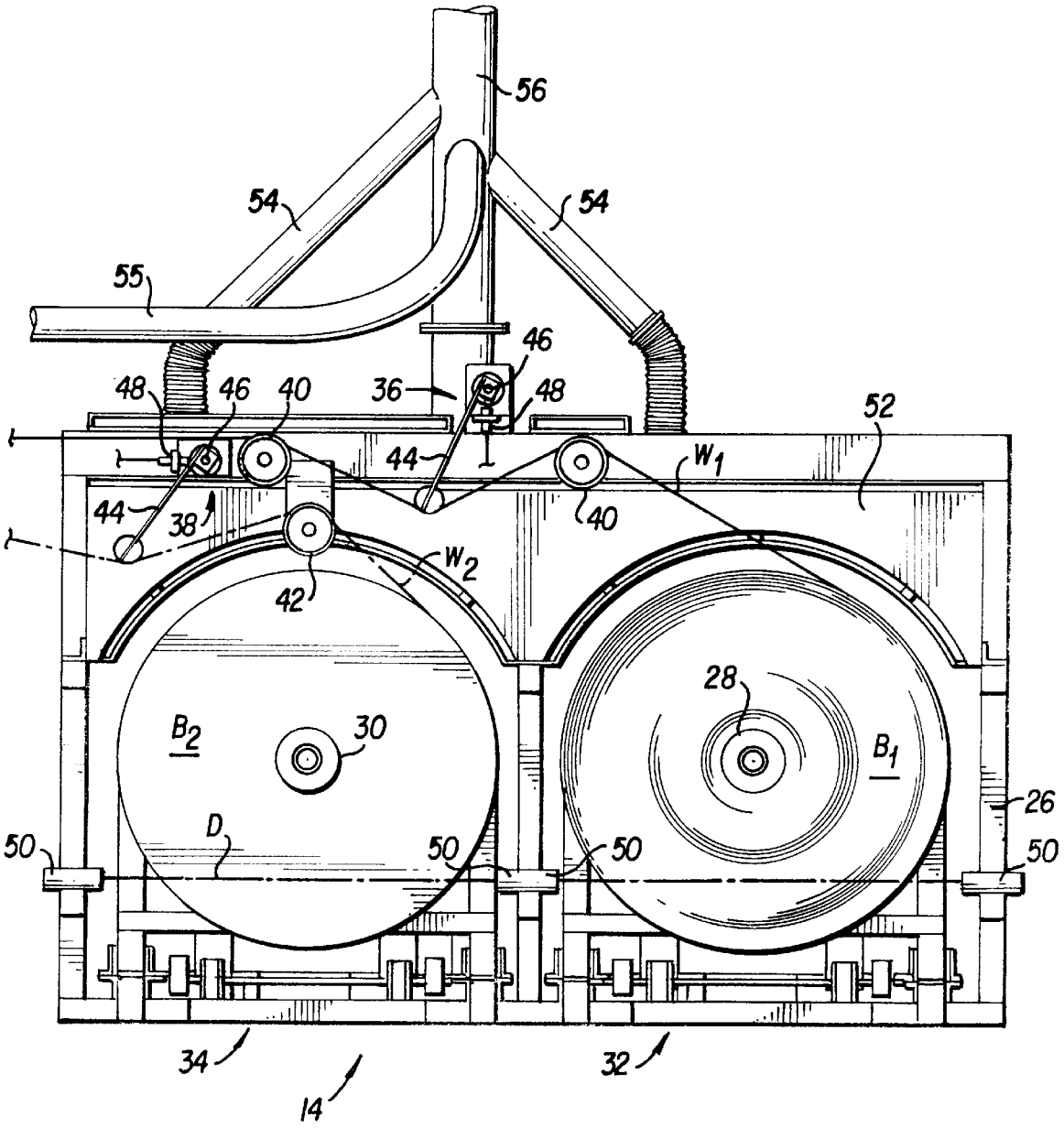
FIG. 2 is a side elevation view of the dual bobbin unwinder apparatus of the invention.

Bobbin speed is controlled by means of first and second control dancers 36, 38 which engage a respective web $W_1$ or $W_2$ passing between guide roller pairs 40 and 42 (only one roller 42 shown in FIG. 2). Control dancers 36, 38 comprise dancer arms 44 which bear upon a respective web $W_1$ or $W_2$ by means of a slight counterclockwise torsion applied to the pivot axes 46 of the dancer arms 44. Assuming the web $W_1$ or $W_2$ is supplied to the KDF filter maker 22 at a constant speed by the capstan roller 17, it will be understood that as the web $W_1$ or $W_2$ on the bobbin $B_1$ or $B_2$ is depleted for a given rotational speed of the bobbin, the dancer arm will begin to pivot clockwise about pivot axis 46. The angular movement of arm 44 is sensed by a sensor 48, such as an optical sensor or any other suitable sensor, and the output of the sensor is used to control the speed of the servo drive motors for the bobbin chucks 28, 30 so as to maintain a constant web speed equal to the capstan roller speed during payout of the web $W_1$ or $W_2$, except during the splicing operation which will be described hereinafter.

Sensors 50 aligned with the web being payed out from each bobbin detect when the web has been unwound or depleted to a given diameter of the bobbin. When that diameter is reached, a pair of the sensors 50 interact along axis D (FIG. 2) and transmit a signal to capstan roller 17 to cause it to increase web speed which, in turn, will cause the dancer arm 44 to pivot clockwise thus sending a signal from sensor 48 to cause the servo drive motor to increase rotational speed of the bobbin associated therewith. This increased web speed is above the speed of the KDF filter maker so that the web will now accumulate in the web reservoir 18 in preparation for the web splicing operation to be described hereafter.

Rotation and payout of the glass webs dislodge glass fibers and glass dust from the preliminary slitting operation into the atmosphere surrounding the bobbins. Such fibers and dust are drawn into a plenum 52 disposed above the bobbins. The plenum 52 is connected via pipes 54, 56 to an exhaust blower (not shown) which draws off the glass fibers and dust for collection and disposal.

Figure 3:
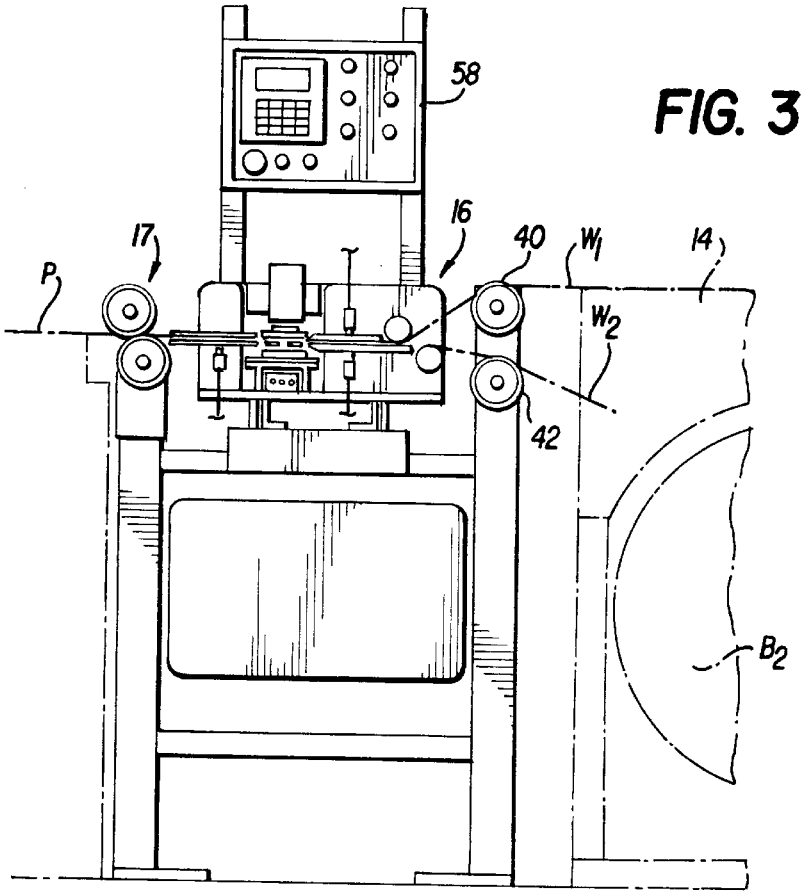
FIG. 3 is a side elevation view of the splicing apparatus of the invention.

FIG. 3 illustrates the splicer apparatus 16 disposed between the capstan roller 17 and the respective guide rollers 40, 42 of the dual bobbin unwinder 14. A control panel 58 for the apparatus 10 is located at the splicer apparatus 16 since an operator is required to be stationed at the splicer to thread the web from alternate bobbins to the splicer and to load the splicer with tape strips for making each splice. It will be seen that the web path P is the same for each of the webs $W_1$ and $W_2$ through the splicer 16 and downstream thereof.

The operation of the splicer apparatus generates a certain amount of glass dust and loose glass fibers. Advantageously, air suction hoses are placed at those locations on the splicer where such dust and fibers are generated. The hoses are connected to the exhaust blower via a pipe 55 (FIG. 2) for carrying away the dust and fibers for collection and disposal. Suction hoses may also be located at any other source of glass dust and fibers in the apparatus 10 and connected to a pipe leading to the exhaust blower.

Figure 10A:
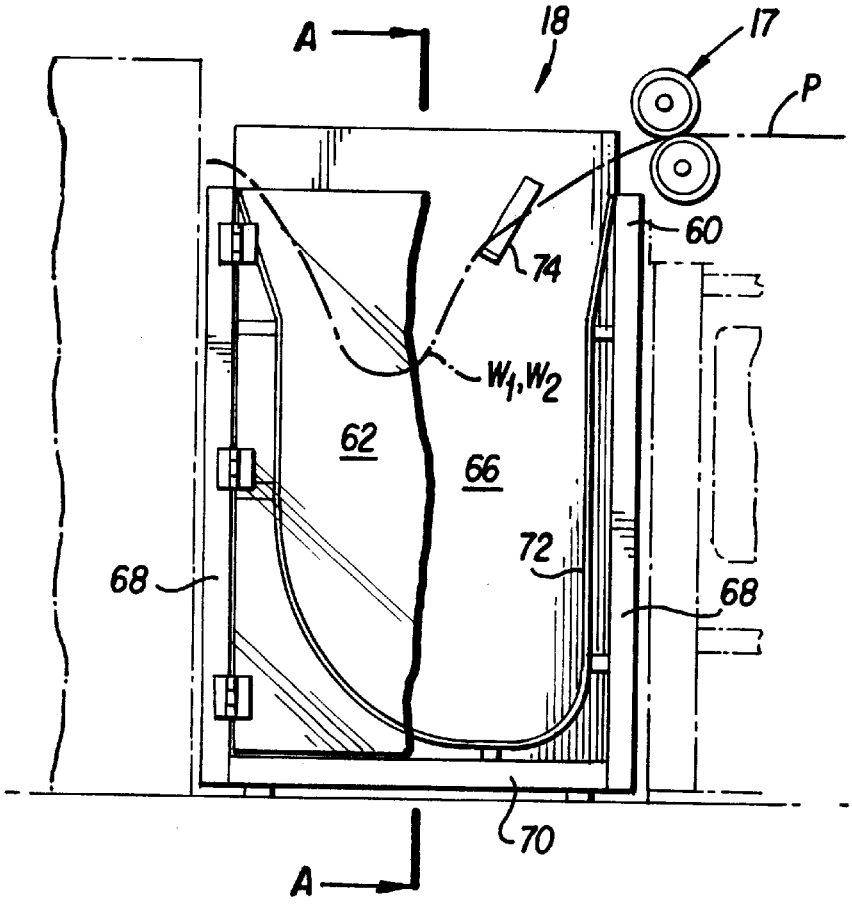
FIG. 10A is a side elevation view of the web reservoir of the invention.
Figure 10B:
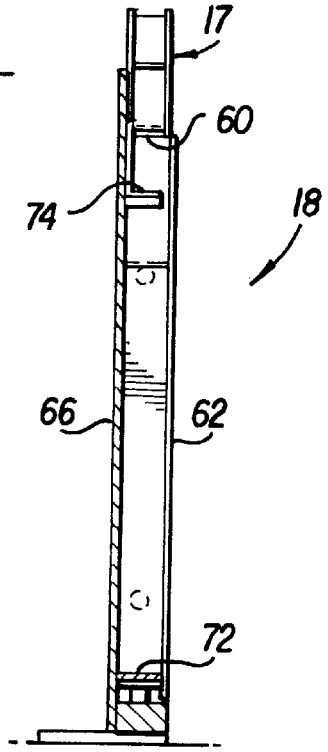
FIG. 10B is a cross-sectional end view of the web reservoir of the invention taken along line A—A of FIG. 10A.

Referring now to FIGS. 10A and 10B the web reservoir 18 comprises a narrow rectangular compartment 60 located just downstream of the capstan rollers 17. A transparent plastic front panel or access door 62 is hinged to the front of the compartment by hinges 64. Should any kinks, twists or tangles occur in the glass web in the web reservoir, they can be visually detected by the operator, easily accessed through the door 62 and corrected or eliminated manually. The compartment 60 comprises a rear metal plate 66, side walls 68 and a bottom wall 70. A curved metal guide 72 is mounted to the walls of the compartment 60 and is shaped to prevent to the greatest extent possible disturbances such as kinks, twists and tangles from occurring in the web as it accumulates in the reservoir. A guide arm 74 is mounted to the rear wall 66 and the web $W_1$ or $W_2$ is guided from the capstan rollers 17 over the arm 74.

The operation of the splicer apparatus 16 will now be described with reference to FIGS. 2–7, particularly FIGS. 4–7. Splicer apparatus 16 comprises inlet web guides 76, 77 and outlet web guides 78, 79 arranged on the upstream and downstream sides respectively of a splicing region. A fixed web spacer 80 is located between guides 76, 77 to form a pair of inlet web guides. Upper and lower web clamps 81, 82 are arranged to clamp the webs $W_1$ and $W_2$ respectively in their respective web guides 76, 80 and 77, 80 and a downstream web clamp 83 is arranged to clamp the web $W_1$ or $W_2$ in the outlet web guide 78, 79 before it is delivered to the capstan rollers 17 and further downstream. Upper and lower air jets 84, 85 are arranged in the inlet web guides to direct a jet of air in the upstream direction for the purpose of ejecting from the splicer the trailing end remnant of a web that has been completely unwound from its bobbin.

A tape base 86 supports a lower strip of splicing tape $T_1$ which is held in place by air suction holes (not shown) in the base 86. Tape clamp 87 supports an upper strip of splicing tape $T_2$ also by air suction holes in the clamp surface and is vertically movable toward and away from the tape base 86. A retractable knife 88 is movable between the base 86 and clamp 87 to cut the web ends square for splicing. Web sensors 89, 90 are positioned to sense the presence of the leading end of webs $W_1$, $W_2$, respectively when a respective web end is positioned for splicing.

The tape base 86 and tape clamp 87 are also movable by mechanisms (not shown) away from the path of travel of the web to facilitate placement of the splicing tape strips $T_1$, $T_2$ on the base and clamp by the operator. For example, the tape base 86 may be moved transversely with respect to the web path P (out of the paper as viewed in FIG. 4) so that tape strips $T_1$ may be easily placed adhesive side out on the upper surface 91 of the base 86. Tape clamp 87 may be pivoted about an axis parallel to web path P so that the lower surface 92 thereof is vertical and faces the operator for tape placement. Other ways of positioning the base 86 and clamp 87 for ease of splicing tape placement will be apparent to those skilled in the art.

Assume that bobbin $B_2$ has just commenced unwinding web $W_2$ which passes through the splicer 16, capstan rollers 17, web reservoir 18 to the composite web maker 20. The operator will move the tape base 86 and tape clamp 87 to their tape loading positions and place the tape strips $T_1$ and $T_2$ on surfaces 91 and 92 respectively where the strips are held by air suction. The leading end of web $W_1$ will be passed under roller 93 and into the space between web guide 76 and web spacer 80 and moved downstream until its presence is sensed by web end sensor 89. Sensor 89 activates upper web clamp 81 to hold the leading end of web $W_1$ in position for splicing. This is the position of the splicer shown in FIG. 4.

Figure 5:
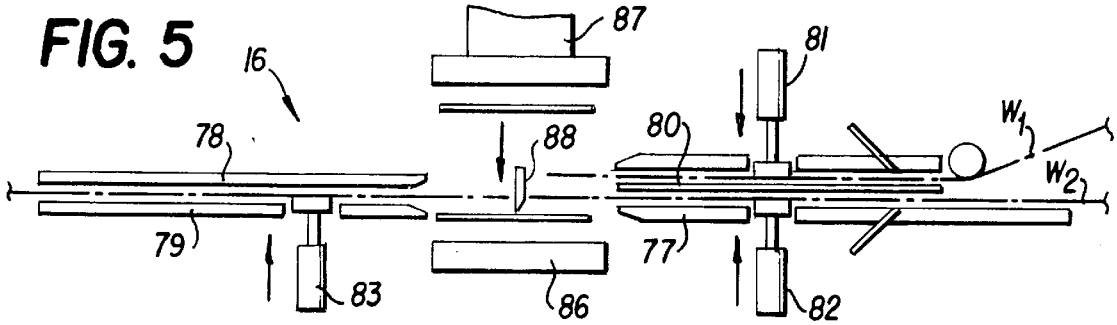

When the sensors 50 (FIG. 2) sense that bobbin $B_2$ has been unwound to a predetermined diameter, a signal is transmitted to the capstan rollers 17 to increase web speed. As capstan rollers 17 increase speed, the dancer arm 44 is pivoted clockwise which causes the servo drive motor to rotate bobbin $B_2$ faster. This will cause web $W_2$ to accumulate in web reservoir in preparation for splicing. At a predetermined speed of the bobbin $B_2$ the servo drive motor stops rotating the bobbin $B_2$, web clamps 82, 83 are activated to clamp web $W_2$ in web guides 77, 80 and 78, 79 and knife 88 cuts web $W_2$ and retracts from between the tape base 86 and tape clamp 87 (FIG. 5).

Figure 6:
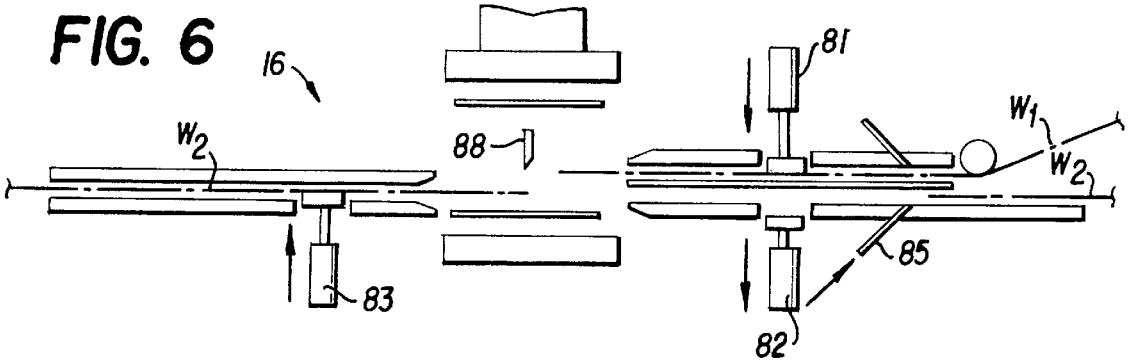
Figure 7:
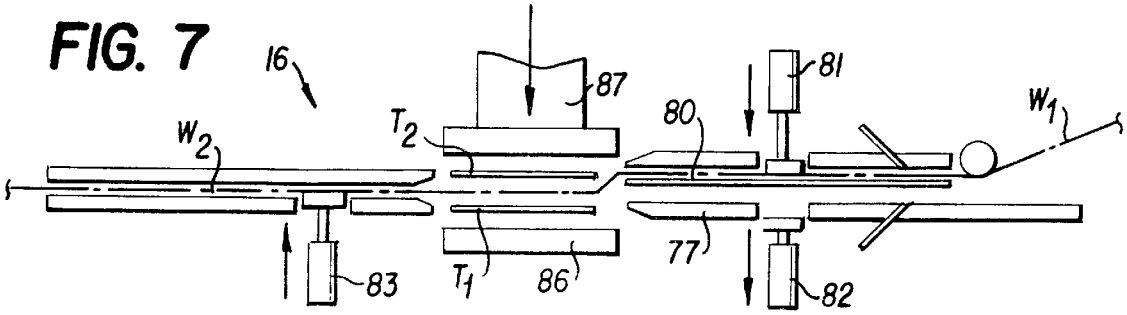

After the knife 88 is retracted, web clamp 82 is deactivated and air jet 85 is operated to eject the web end remnant of web $W_2$ from the splicer 16 (FIG. 6). Thereafter, tape clamp 87 is moved downwardly against tape base 86 to press the adhesive side of the tape strips $T_1$, $T_2$ against the upper and lower web surfaces adjacent the trailing end of web $W_2$ and the leading end of web $W_1$ to form the splice (FIG. 7).

After the splice is formed, the tape clamp 87 and web clamps 81, 83 retract and capstan rollers 17 begin pulling the spliced glass web through the splicer. During the splicing operation, the KDF filter maker 22 and composite web maker 20 were supplied with web from the web reservoir 18 and thus used up most of the accumulated web $W_2$ in the reservoir. Bobbin carriage 34 is next indexed the width of a web to align the next adjacent web on bobbin $B_2$ with the web path P. The operator then loads the splicer with new tape strips $T_1$, $T_2$ and threads the leading end of the next web $W_2$ into web guide 77, 80 up to sensor 90 which activates web clamp 82 to position web $W_2$ for the next splice which proceeds as generally described above in connection with FIGS. 4–7, except that the web being payed out is web $W_1$ and the web clamped for splicing is web $W_2$.

Figure 8:
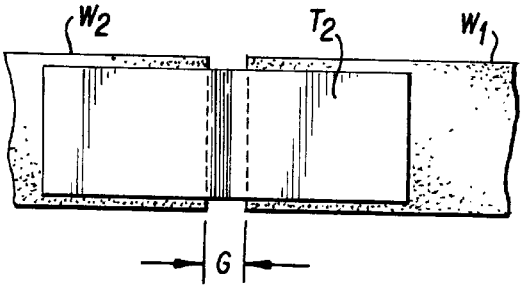
FIG. 8 is a fragmentary top plan view of a splice made according to the invention in the splicing apparatus of FIG. 3.
Figure 9:
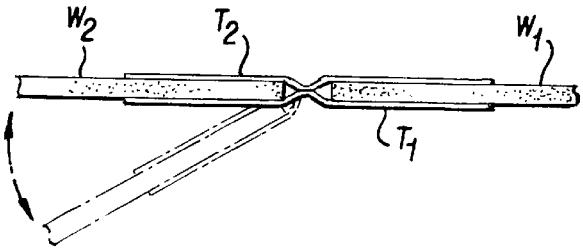
FIG. 9 is a fragmentary side elevation view of a splice made according to the invention in the splicing apparatus of FIG. 3.
Figure 4:
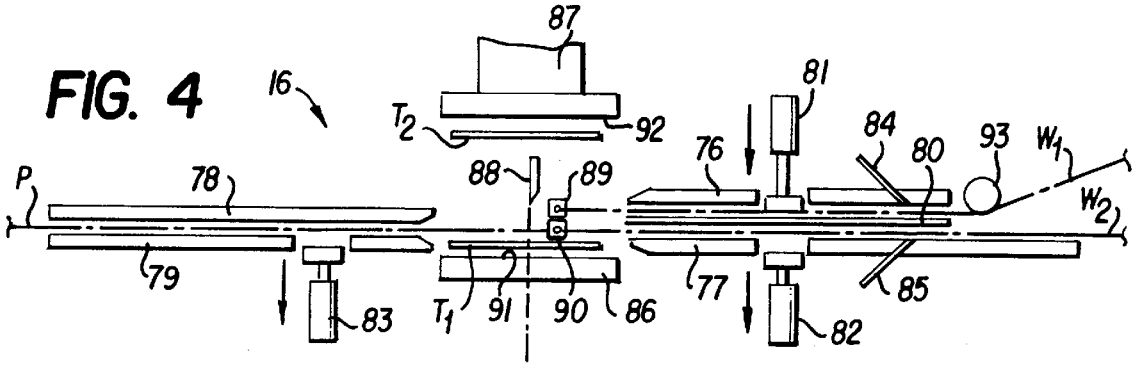
FIGS. 4–7 are schematic views illustrating the sequential steps for making a splice of two glass webs in the splicing apparatus of FIG. 3.

The sensors 89, 90 are located slightly upstream of the cutting plane of knife 88 (FIG. 4) so that when the splicing tape strips $T_1$, $T_2$ are applied to the ends of the webs $W_1$, $W_2$, a gap G of about ⅛inch to about ⅜inch is formed between the web ends. Referring to FIGS. 8 and 9, the preferred splice structure is shown with gap G between the ends of the webs $W_1$ and $W_2$. The width of tapes $T_1$, $T_2$ is preferably less than the width of the webs $W_1$, $W_2$. The presence of gap G results in a much stronger and more reliable spliced joint between the webs $W_1$, $W_2$. If the web ends were arranged to abut against one another, flexure of the joint as shown in phantom lines in FIG. 9 could result in detachment or loosening of the adhesive bond between tape $T_2$ and the ends of webs $W_1$ and $W_2$.

Figure 11:
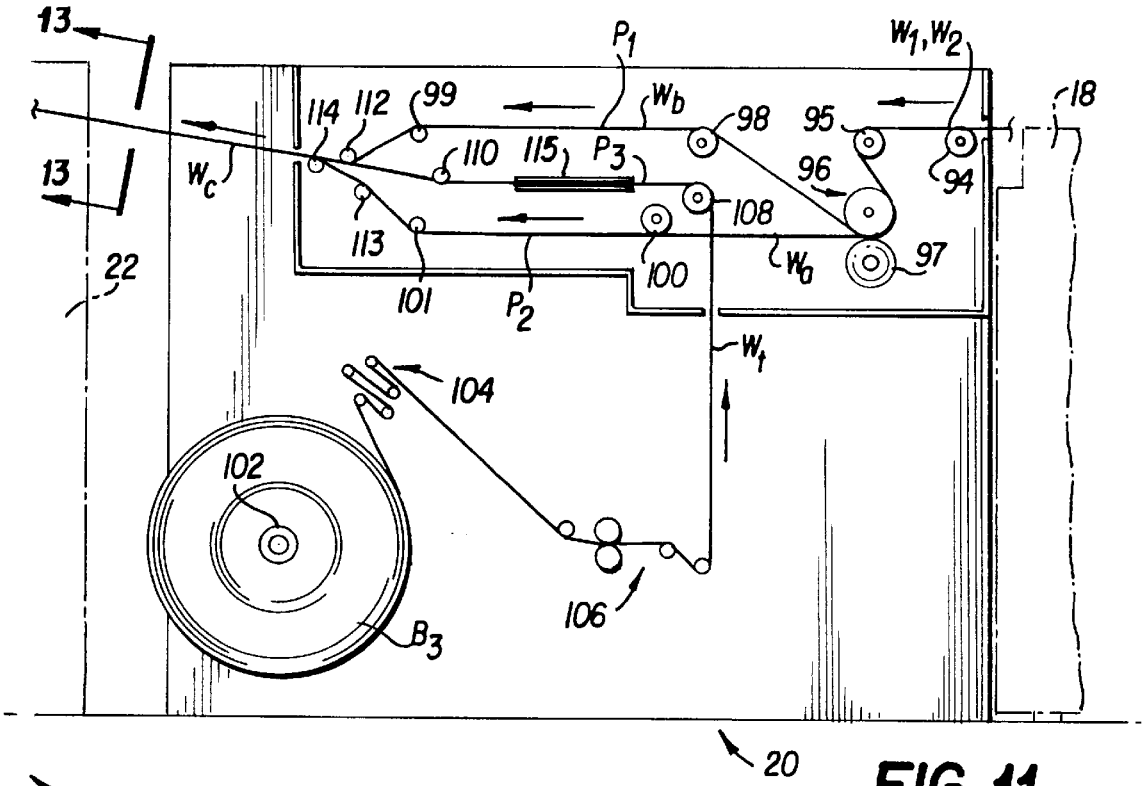
FIG. 11 is a side elevation view of the apparatus of the invention for making the composite glass/paper web.
Figure 12:
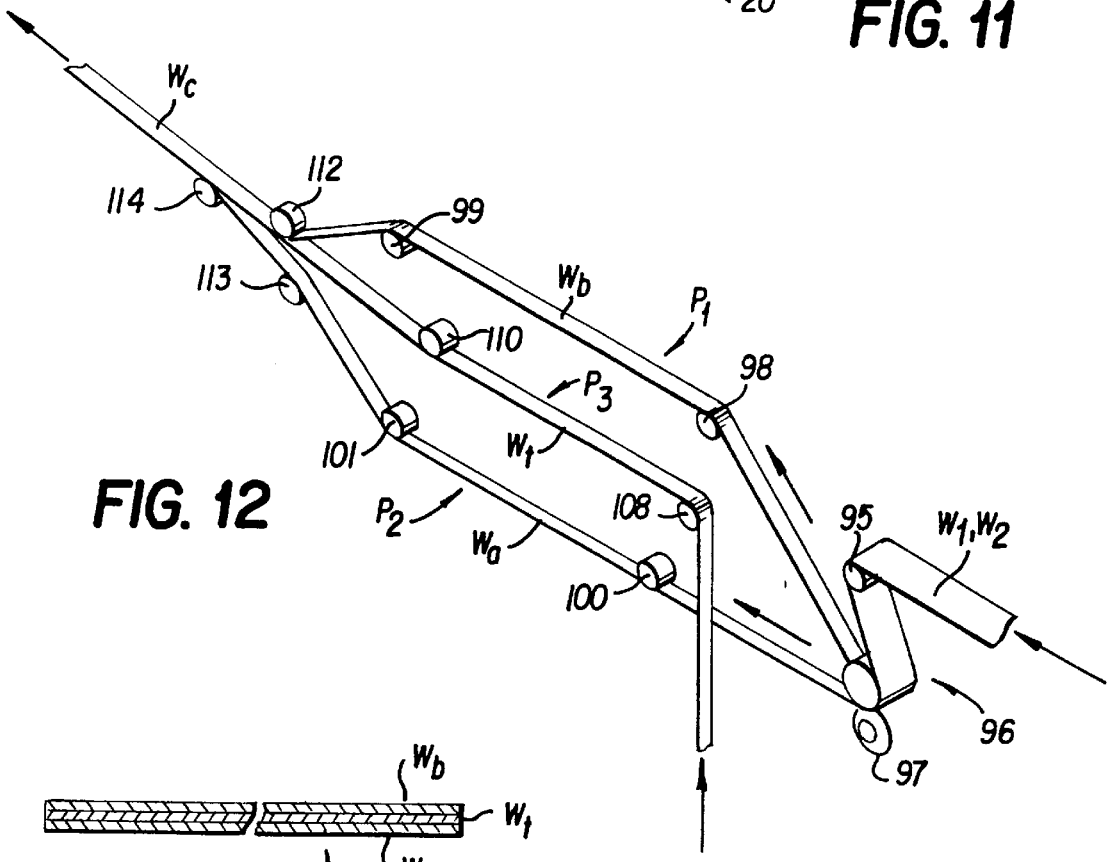
FIG. 12 is a perspective view showing the manner in which the apparatus of FIG. 11 forms the composite web structure.
Figure 13:
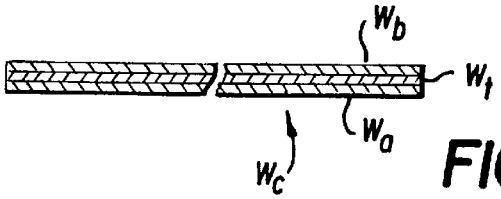
FIG. 13 is a cross-sectional view of the composite web taken along line 13—13 of FIG. 11.

FIGS. 11 and 12 illustrate the composite web maker or former 20 into which the web $W_1$ or $W_2$ passes from the web reservoir 18. The fill width (38 mm) web travels over guide rollers 94, 95 to a web slitter 96 where the web is slit longitudinally by cutter 97 into two equal strips $W_a$, $W_b$ each having a width of about 19 mm. Webs $W_a$ and $W_b$ are separated at slitter 96 along vertically spaced paths of travel $P_1$ $P_2$ about respective sets of guide rollers 98, 99 and 100, 101. A bobbin $B_3$ of a tobacco paper web $W_t$ is mounted on a bobbin chuck 102. The web $W_t$ is pulled from the bobbin $B_3$ by the KDF filter maker at the same speed as the webs $W_a$, $W_b$. Web $W_t$ passes over and about a plurality of conventional rollers 104, 106 and then vertically upwardly to a roller 108 positioned intermediate the paths $P_1$, $P_2$ where it is transversely aligned and guided by guide 115 to a roller 110 along a path $P_3$ substantially parallel to paths $P_1$, $P_2$. Beginning at the rollers 98, 100, 108 and continuing to rollers 99, 101, 110, the three webs $W_a$, $W_b$, $W_t$ are directed into a transversely aligned, overlapping relation and are then caused to converge by rollers 112, 113, 114 into a three layer composite web $W_c$ comprising tobacco paper web $W_t$ sandwiched between glass webs $W_a$, and $W_b$ as shown in FIG. 13.

Web $W_c$ passes downstream from composite web maker 20 to the KDF filter maker 22 where it is wrapped about the carbonaceous fuel rod from the extruder 12 and overwrapped with paper to form a continuous carbonaceous fuel element for use in a smoking article.

The apparatus 10 operates generally as follows: A carbonaceous rod is continuously extruded from extruder 12 and is conveyed via a conveyor 24 directly to the KDF filter maker 22 where it is combined with a composite glass/tobacco paper web and a paper overwrap to form a continuous carbonaceous fuel rod which is subsequently cut into individual fuel elements for use in making a smoking article. The composite glass/tobacco paper web $W_c$ is also continuously formed in parallel with the carbonaceous rod and is supplied to the KDF filter maker 22 along with the paper overwrap.

The composite web $W_c$ is continuously formed by unwinding from alternate bobbins $B_1$, $B_2$ of a dual bobbin unwinder 14, webs $W_1$, $W_2$ of a given length and semi-automatically splicing the webs together in a splicer apparatus 16. Prior to the splicing operation, the unwinder 14 speeds up to accumulate an excess of web material in a web reservoir 18 so that when the webs are held stationary for splicing together, the KDF filter maker is supplied with sufficient web material so that production rate is maintained constant.

The glass webs $W_1$ and $W_2$ are twice the width of the finished composite web. Thus, fewer slits are necessary on the web bobbins and the webs $W_1$ and $W_2$ can withstand greater tensile forces without breakage or stretching. Moreover, only one dual bobbin unwinder is needed since the web is slit into two webs downstream of the splicer. If the webs were supplied at the width of the finished composite web, two unwinders and four bobbins would be needed to maintain a continuous process.

In the composite web maker 20, the web $W_1$ or $W_2$ is slit into two equal webs $W_a$, $W_b$ and vertically separated by a roller system. A tobacco paper web $W_t$ is interposed between the webs $W_a$, $W_b$ and sandwiched between them as the webs are converged both laterally and vertically by the roller system into a three-layer composite web $W_c$ . Thereafter, the composite web $W_c$ is fed to the KDF filter maker 22 where it is wrapped about the carbonaceous rod and overwrapped with a paper overwrap in a conventional manner for use in a smoking article.

Although certain presently preferred embodiments of the present invention have been specifically described herein, it will be apparent to those skilled in the art to which the invention pertains that variations and modifications of the various embodiments shown and described herein may be made without departing from the spirit and scope of the invention. Accordingly, it is intended that the invention be limited only to the extent required by the appended claims and the applicable rules of law.

We claim:

1. A method of continuously forming a composite web for use in the manufacture of a smoking article comprising the steps of:

unwinding a first fiberglass web having a given width from a first bobbin along a path of travel;

providing a second fiberglass web of said given width wound on a second bobbin, said second fiberglass web having a leading end;

positioning the leading end of said second fiberglass web at a splicing region located along the path of travel;

stopping the unwinding of the first fiberglass web;

cutting the stopped first fiberglass web along a cutting plane at the splicing region to form a trailing end of the first fiberglass web and a web remnant of the first fiberglass web;

splicing the leading end of the second fiberglass web to the trailing end of the first fiberglass web at the splicing region to form a joint between said ends; and unwinding the second fiberglass web from the second bobbin along said path of travel;

slitting said first web or said second web into two narrow webs of substantially equal widths at a slitting region along the path of travel downstream of the splicing region;

separating said two narrow webs into a spaced relation;

guiding a paper web between said two narrow webs; and converging said two narrow webs and said paper web together to form a three layer composite web with said paper web sandwiched between said two narrow webs.

2. The method of claim 1, including the steps of sensing the diameter of the remaining web on the first or second bobbin, and stopping the unwinding of the first or second fiberglass web at a predetermined speed of the first or second bobbin.

3. The method of claim 1, including the step of applying a pressurized fluid to eject the web remnant of the first fiberglass web before the splicing step and after the cutting step.

4. The method of claim 1, wherein the path of travel of the first and second fiberglass webs through the splicing region is in a substantially horizontal plane and including the step of clamping the first fiberglass web upstream and downstream of the splicing region when the first fiberglass web is stopped and during the cutting step.

5. The method of claim 1, wherein said splicing step includes the step of applying splicing tape strips to the upper and lower surfaces of the first and second fiberglass webs in the splicing region to form said joint.

6. The method of claim 1, including the step of sensing the amount of unwound web on the first bobbin increasing the unwinding speed of the first bobbin when a predetermined amount of the first web remains on the bobbin and prior to stopping the unwinding of the first fiberglass web, and accumulating a length of the first fiberglass web downstream of the splicing region.

7. The method of claim 1, including the step of spacing the leading end of the second fiberglass web from the trailing end of the first fiberglass web from one another prior to splicing to form said joint with a fixed gap of predetermined dimension therebetween.

8. The method of claim 7, wherein said predetermined dimension is about ⅛inch to about ⅜inch.

9. The method of claim 1, including the steps of alternately paying out a fiberglass web from the first and second bobbins and splicing the fiberglass webs together in the splicing region so as to continuously supply a fiberglass web for forming the composite web.

* * * * *